US010945455B1

(12) United States Patent
Wang

(10) Patent No.: US 10,945,455 B1
(45) Date of Patent: Mar. 16, 2021

(54) FULL GLASS ATOMIZER

(71) Applicant: Shenzhen Shikai Technologies Co. Ltd., Fuyong (CN)

(72) Inventor: Shenyi Wang, Shenzhen (CN)

(73) Assignee: Shenzhen Shikai Technologies Co. Ltd.

( * ) Notice: Subject to any disclaimer, the term of this patent is extended or adjusted under 35 U.S.C. 154(b) by 0 days.

(21) Appl. No.: 17/117,614

(22) Filed: Dec. 10, 2020

(51) Int. Cl.
*A24F 40/42* (2020.01)
*A24F 40/46* (2020.01)

(52) U.S. Cl.
CPC ..... *A24F 40/42* (2020.01); *A24F 40/46* (2020.01)

(58) Field of Classification Search
None
See application file for complete search history.

(56) References Cited

U.S. PATENT DOCUMENTS

| | | | |
|---|---|---|---|
| D167,230 | S | 7/1952 | Rehfeld |
| D413,002 | S | 8/1999 | Melograno |
| D688,415 | S | 8/2013 | Kim |
| 8,678,012 | B2 | 3/2014 | Li |
| D724,264 | S | 3/2015 | Chambers |
| D724,779 | S | 3/2015 | Liu |
| D730,571 | S | 5/2015 | Chen |
| D747,545 | S | 1/2016 | Liu |
| D749,261 | S | 2/2016 | Chen |
| D752,279 | S | 3/2016 | Liu |
| 9,345,269 | B2 | 5/2016 | Liu |
| D769,519 | S | 10/2016 | Chen |
| D772,478 | S | 11/2016 | Liu |
| 9,497,998 | B2 * | 11/2016 | Chen ..... A24F 40/40 |
| D774,247 | S | 12/2016 | Chen |
| 9,510,624 | B2 | 12/2016 | Li |
| 9,526,272 | B2 | 12/2016 | Liu |
| 9,538,788 | B2 | 1/2017 | Cyphert |
| D778,492 | S | 2/2017 | Liu |
| 9,661,878 | B2 | 5/2017 | Liu |
| D800,381 | S | 10/2017 | Chen |
| 9,788,577 | B2 | 10/2017 | Liu |
| D817,543 | S | 5/2018 | Liu |
| D825,834 | S | 8/2018 | Chen |
| D826,471 | S | 8/2018 | Wang |
| D827,152 | S | 8/2018 | Ou |
| D828,623 | S | 9/2018 | Fornarelli |
| D836,243 | S | 12/2018 | Liu |
| D849,317 | S | 5/2019 | Qiu |
| D849,318 | S | 5/2019 | Deng |
| 10,278,426 | B2 | 5/2019 | Gadas |
| D853,635 | S | 7/2019 | Chen |
| 10,383,368 | B2 | 8/2019 | Larson |
| D861,978 | S | 10/2019 | Lai |
| D863,666 | S | 10/2019 | Wang |
| D869,753 | S | 12/2019 | Yang |

(Continued)

*Primary Examiner* — James Harvey
(74) *Attorney, Agent, or Firm* — QuickPatents, LLC; Kevin Prince

(57) ABSTRACT

A glass atomizer comprises an oil storage chamber made of glass fused to and encompassing an airflow channel also made of glass. The oil storage chamber and airflow channel are further fused to a glass nozzle, where an externally threaded metal ring is affixed to the oil storage chamber at the end opposite from the nozzle. The externally threaded metal ring is removably joinable with an internally threaded connecting sleeve housing an atomizing core.

22 Claims, 5 Drawing Sheets

(56) References Cited

U.S. PATENT DOCUMENTS

| | | | | |
|---|---|---|---|---|
| 10,492,525 | B2 * | 12/2019 | Ou | A24F 5/10 |
| 10,506,827 | B2 | 12/2019 | Guo | |
| 10,524,504 | B2 | 1/2020 | Li | |
| D875,306 | S | 2/2020 | Pan | |
| D877,975 | S | 3/2020 | Crowe | |
| 10,582,728 | B2 | 3/2020 | Liu | |
| 10,602,778 | B2 | 3/2020 | Hu | |
| D882,165 | S | 4/2020 | Ouyang | |
| D883,567 | S | 5/2020 | Liu | |
| D885,653 | S | 5/2020 | Ding | |
| 10,716,331 | B2 | 7/2020 | Biel | |
| D892,398 | S | 8/2020 | Yuan | |
| D893,798 | S | 8/2020 | Liu | |
| D894,478 | S | 8/2020 | Fornarelli | |
| D897,840 | S | 10/2020 | Ou | |
| D898,993 | S | 10/2020 | Li | |
| D899,677 | S | 10/2020 | Liu | |
| D900,387 | S | 10/2020 | Liu | |
| 10,791,764 | B2 | 10/2020 | Chen | |
| 2014/0007863 | A1 | 1/2014 | Chen | |
| 2014/0109898 | A1 | 4/2014 | Li | |
| 2014/0130817 | A1 | 5/2014 | Li | |
| 2014/0332022 | A1 | 11/2014 | Li | |
| 2014/0376895 | A1 * | 12/2014 | Han | A24F 40/40 392/395 |
| 2015/0040927 | A1 | 2/2015 | Li | |
| 2015/0189918 | A1 | 7/2015 | Liu | |
| 2015/0257444 | A1 | 9/2015 | Chung | |
| 2015/0272218 | A1 | 10/2015 | Chen | |
| 2015/0335073 | A1 | 11/2015 | Li | |
| 2016/0015082 | A1 * | 1/2016 | Liu | A24F 47/008 131/329 |
| 2017/0006916 | A1 | 1/2017 | Liu | |
| 2017/0027230 | A1 | 2/2017 | Fornarelli | |
| 2017/0311645 | A1 | 11/2017 | Liu | |
| 2018/0311687 | A1 * | 11/2018 | Li | B05B 7/0475 |
| 2018/0317550 | A1 | 11/2018 | Zhu | |
| 2018/0317551 | A1 | 11/2018 | Daryani | |
| 2019/0307169 | A1 | 10/2019 | Yuan | |
| 2019/0351156 | A1 | 11/2019 | Guduru | |
| 2020/0022413 | A1 | 1/2020 | Zhang | |
| 2020/0170299 | A1 | 6/2020 | Yuan | |
| 2020/0178615 | A1 | 6/2020 | Liu | |
| 2020/0181003 | A1 | 6/2020 | Peuchert | |
| 2020/0187567 | A1 | 6/2020 | Liu | |
| 2020/0297035 | A1 | 9/2020 | Huang | |
| 2020/0315258 | A1 | 10/2020 | Yuan | |
| 2020/0315262 | A1 | 10/2020 | Liu | |
| 2020/0323042 | A1 | 10/2020 | Guo | |

* cited by examiner

FULL GLASS ATOMIZER

CROSS-REFERENCE TO RELATED APPLICATIONS

This application claims the benefit of Chinese Patent Application 202020730938.X, filed on May 6, 2020, and is incorporated herein by reference.

STATEMENT REGARDING FEDERALLY SPONSORED RESEARCH AND DEVELOPMENT

Not Applicable.

FIELD OF THE INVENTION

The utility model relates to the fields of medical assistance and electronic atomization, more specifically, to a full glass atomizer.

BACKGROUND

"Atomizer" generally refers to a device for atomization therapy, commonly used as medical equipment for treating respiratory diseases, such as cough and asthma, and other diseases that can be treated by atomization. Over the last few years, atomizers have been widely used in the medical and electronic cigarette industries as a medical device and smoking cessation equipment, respectively.

The global atomizer market has enacted higher requirements for the hygiene, environmental protection, and safety of atomizers. So far, most atomizers on the market use metal to build the oil reservoir and atomization parts, which could cause heavy metals to exceed standards and pollute oil used in atomization. Moreover, since the oil is in direct contact with the metal, the oil may easily deteriorate, leading to shortened cycle of lifetime of the atomizer, affecting the smoking taste, and also endangering people's health.

Furthermore, most atomizers on the market usually join to the battery through threads, which is prone to the situation that the bottom threads cannot be taken out and the suction nozzle is detached from the rest of atomizer during disassembly, causing inconvenience for the customers.

In addition, most atomizers on the market do not support oil refill, resulting in waste of resources. After adding the oil, it is critical to assemble the seal immediately, otherwise oil may leak. Adding oil is inconvenient, and oil leakage often occurs during long-term storage.

Furthermore, the available atomizers on the market often encounter problems such as oil accumulation, oil blocking, and oil leakage in the vent pipe, leading to an unpleasant user experience.

SUMMARY OF THE INVENTION

This utility model aims to provide a safe and reliable all-glass atomizer which has no heavy metal pollution and is easy to refill, assemble, and operate. In order to achieve these goals, this utility model adopts the following innovations:

A full glass atomizer comprises a glass suction nozzle and an atomizing core, the glass suction nozzle comprises an atomizer tank and an atomizer tank base. The atomizing core comprises a connecting sleeve, a threaded base, a base cover, a silicone base, ceramic heating wire, a cotton pad, an insulation ring, and an electrode.

The top of the atomizer tank is the nozzle, and the nozzle extends to form two hollow cylinders. The inner hollow cylinder forms the airflow channel, and the space between the inner hollow cylinder and outer hollow cylinder forms the oil tank. The bottom of the atomizer tank is connected to the atomizer tank base. The bottom of the atomizer tank base contains external threads through which the atomizer tank base connects to the connecting sleeve.

The threaded base is at the bottom of the atomizing core. The connecting sleeve 3 is between the threaded base 4 and the base cover 5. The silicone base is located on the top of the base cover. The top of the silicone base forms a tight seal with the bottom of atomizer tank. The ceramic heating wire is wrapped in the cotton pad and placed in the silicone base. The insulation ring is placed into the threaded base. The electrode is placed in the insulating ring. The glass suction nozzle, the silicone base, the base cover, and the threaded base contain hollow centers. The threaded base and the silicone base contain side holes.

Further, the atomizing core also includes a connecting sleeve. The connecting sleeve has internal threads through which the connecting sleeve connects to the atomizer tank base. The connecting sleeve is arranged on the threaded base and forms a movable ring by clamping the base cover.

Further, the bottom of the atomizer tank base contains external threads through which the atomizer tank base connects to the connecting sleeve. Also, there is a positioning ridge on the lower internal wall of the atomizer tank base.

Further, the upper outside of the base cover contains raised triangle shape, and the upper edge of the base cover has two notches. The lower internal wall of the atomizer tank base contains a positioning ridge. By inserting the top of base cover to the bottom of atomizer tank base and keeping the raised triangle shape at the same level as the positioning ridge, the base cover and the atomizer tank base are butted together.

Further, because the rotation stops when the positioning ridge meets the raised triangle shape, the rotation between the base cover and the atomizer tank base is limited to 180 degrees.

Further, the silicone base contains two symmetrically arranged external ridges. The external ridge will be inserted into the notch on the base cover.

Further, the upper outside of the silica base contains symmetrically arranged V-shaped oil inlet groove. At the lower center of the V-shaped oil inlet groove, there is an oil inlet. There is a sealing ring between the external ridge and the V-shaped oil inlet grooves. After assembly, the sealing ring contacts the bottom of the atomizer tank to form a tight seal.

Further, the atomizer tank base has an internal groove, and the atomizer tank has a connecting end which has slightly smaller radius compared to the rest of the atomizer tank. During assembly, the internal groove is filled with glue and inserted into the connecting end of the atomizer tank to fix them together.

Further, the nozzle, the oil tank, and the airflow channel are formed into an integrated glass structure.

Using the innovations listed above, this utility model has the following beneficial effects:

1. The oil reservoir of the present invention is made of glass and sealed with silicone. There is no metal involved, resulting in an environmentally friendly and healthy atomizer without the risk of heavy metal pollution. The glass suction nozzle and oil tank are made of glass which is transparent and has an attractive and modern appearance.

2. This utility model uses the self-innovative silicone V-shaped oil inlet groove which prevents heavy metal pollution from the metal parts used in other atomizers.

3. The nozzle, the oil tank, and the airflow channel are integrated into a unified glass structure. The bottom of airflow channel connects to the ceramic heating wire wrapped in the cotton pad. When in use, the condensation on the wall of the airflow channel flows back to the ceramic heating wire and the cotton pad which prevents oil accumulation, oil blocking and oil leakage in the ventilation pipe.

4. This utility model is convenient for refueling. The top of the oil tank is annular which offers a 360-degree refueling area. Immediate assembly is not required right after refueling. There will be no oil leakage caused by structural sealing problems.

5. This utility model adopts an innovative positioning thread structure. By having the raised triangle shape from suction nozzle misaligned and butted to the positioning ridge from the atomizer tank base, the glass suction nozzle and the base of the atomizing core will not spin. After assembly, the atomizer is integrated into one piece, making it easy to install and remove the atomizer from the battery. The base will never be stuck to the battery and the suction nozzle and the base will not separate during battery removal.

Through the detailed description and drawings, the unique advantages of this utility model become more apparent.

DETAILED DESCRIPTION OF THE PREFERRED EMBODIMENT

In the figures the following reference numbers and components are described:

1. Atomizer tank;
2. Atomizer tank base;
3. Connecting sleeve or externally threaded metal ring;
4. Threaded base;
5. Base cover or annular ring;
6. Electrode;
7. Silicone base or nonmetal frame;
8. Insulation ring;
9. Ceramic heating wire or heating element;
10. Cotton pad or absorbent material;
101. Suction nozzle;
102. Oil tank or oil storage chamber;
103. Airflow channel;
104. Connecting end or lower portion of an external wall of the oil storage chamber;
201. External threads;
202. Internal groove;
203. Positioning ridge;
301. Internal threads;
401. Air inlet;
402. External threads;
403. Internal step;
404. Wide wall;
405. Base inner hole;
501. Raised triangle shape;
502. Notch;
503. Central inner hole;
601. Small electrode head;
701. Sealing ring;
702. External ridge;
703. V-shaped oil inlet groove;
704. Oil inlet;
705. Central hole;
801. Head of insulation ring;
901. Porous ceramics;
902. Heating wire; and
903. Terminal pins.

SPECIFIC MODE FOR CARRYING OUT THE INVENTION

The utility model will be described in more detail below. Please note that the protection scope of the invention is not limited to this.

Figure 1:
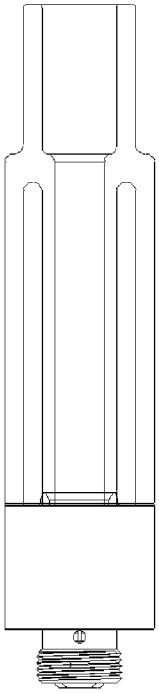
FIG. 1 is a perspective view of an embodiment of the utility model.
Figure 2:
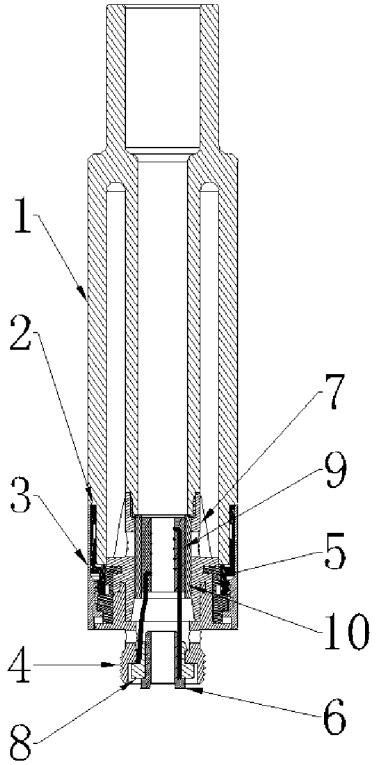
FIG. 2 is a cross-sectional view of FIG. 1.
Figure 3:
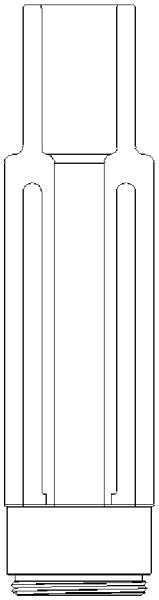
FIG. 3 is a perspective view of the suction nozzle of an embodiment of the utility model.
Figure 4:
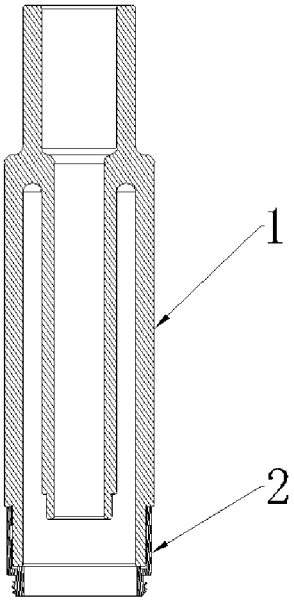
FIG. 4 is a cross-sectional view of FIG. 3.
Figure 5:
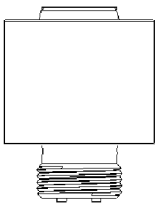
FIG. 5 a perspective view of the atomizing core piece of an embodiment of the utility model.
Figure 6:
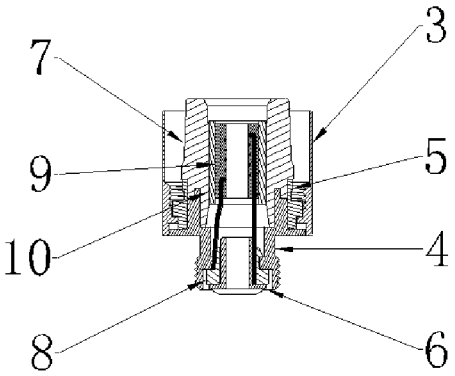
FIG. 6 is a cross-sectional view of FIG. 5.
Figure 7:
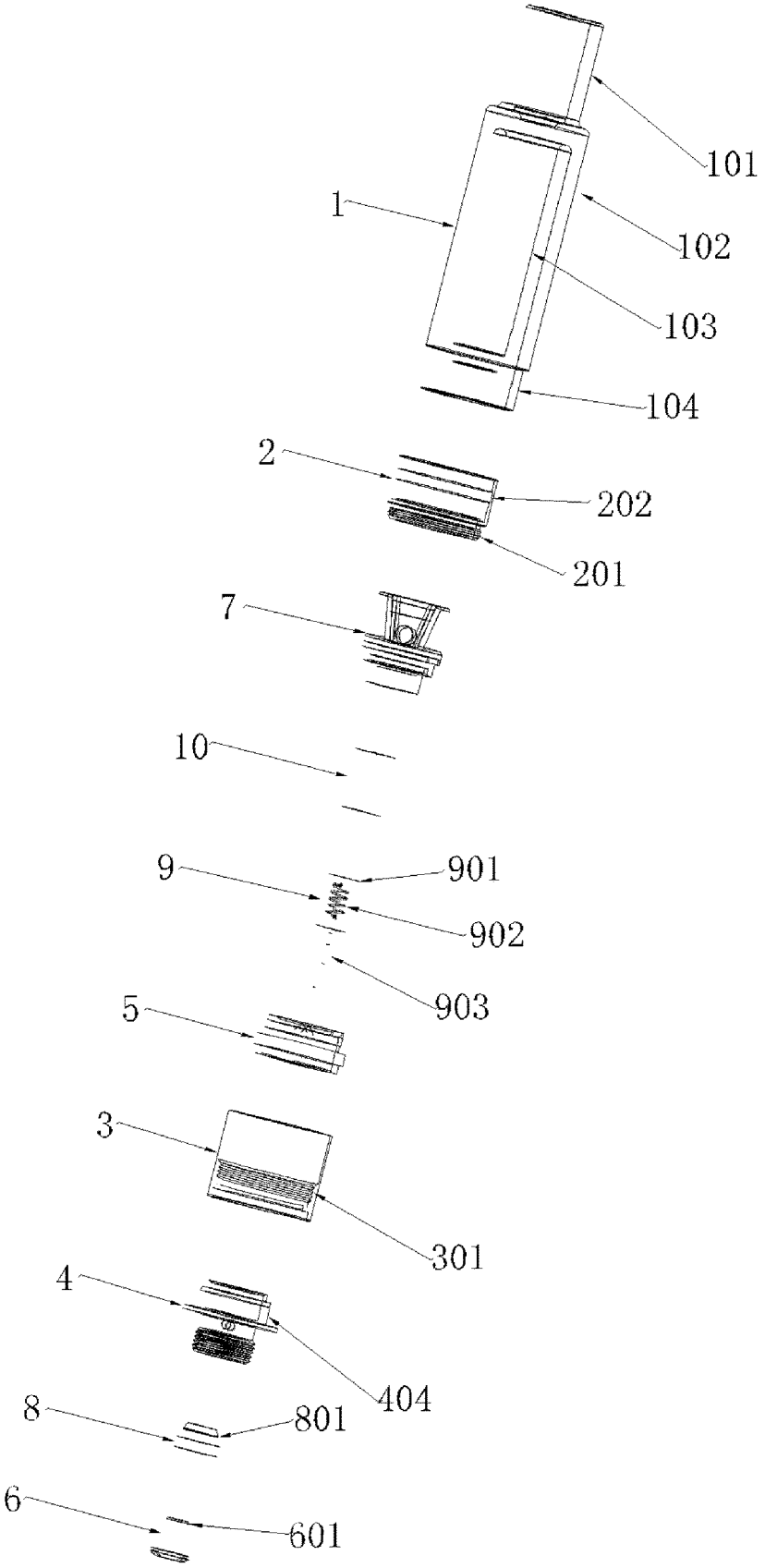
FIG. 7 is an exploded perspective view of a full glass atomizer shown in FIG. 1.
Figure 8:
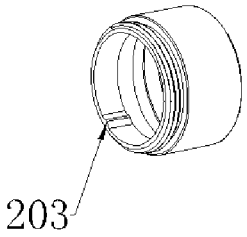
FIG. 8 is a perspective view of the atomizer base.
Figure 9:
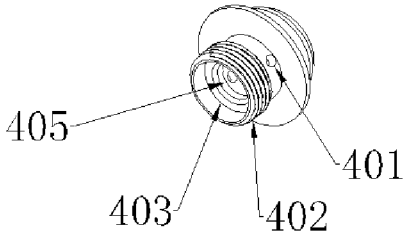
FIG. 9 is a perspective view of the threaded base.
Figure 10:
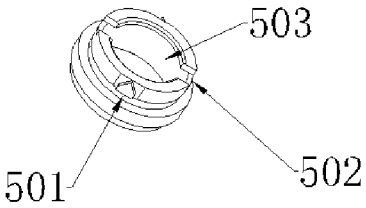
FIG. 10 is a perspective view of the base cover.
Figure 11:
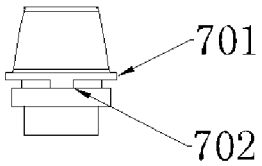
FIG. 11 is a perspective view of the silicone base.
Figure 12:
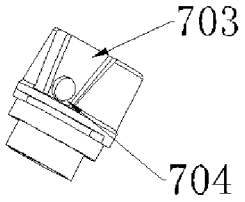
FIG. 12 is another perspective view of the silicone base.
Figure 13:
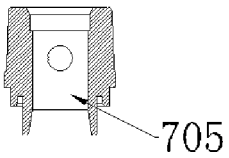
FIG. 13 is a sectional view of the silicone base.

As shown in FIG. 1-13, the utility model relates to the field of medical assistance and electronic atomization, in particular to a full glass atomizer, which comprises a glass suction nozzle and an atomization core, the glass suction nozzle assembly comprises an atomizer tank 1 and an atomizer tank base 2. The top of the atomizer tank 1 is the nozzle 101, and the inner hollow cylinder of atomizer tank 1 below the nozzle forms the airflow channel 103. The space between the inner hollow cylinder and outer hollow cylinder of atomizer tank forms the oil tank 102. The nozzle 101, the oil tank, 102 and the airflow channel 103 are integrated together to form one piece of glass. The bottom of the atomizer tank 1 has a connecting end 104, and the atomizer tank base has an internal groove. The internal groove is filled with glue, and then the connecting end 104 of the atomizer tank 1 is inserted into the atomizer tank base 2 to have the atomizer tank and the atomizer tank base fixed together. The bottom of the atomizer tank base 2 contains external threads 201 through which the atomizer tank base connects to the connecting sleeve 3. On the lower inner wall of the atomizer tank base 2, there is a positioning ridge 203.

The atomizing core includes connecting sleeve 3, threaded base 4, base cover 5, silicone base 7, ceramic heating wire 9, cotton pad 10, insulating ring 8 and electrode 6. The connecting sleeve 3 has internal threads 301 through which the connecting sleeve connects to the atomizer tank base 2. The threaded base 4 has a hollow thread structure, the middle of which is the base inner hole 405, and its bottom contains external threads 402 through which the threaded base connects to the external battery. Above the external threads 402, there are two air inlets 401 symmetrically arranged on the threaded base. At the lower end of the base inner hole 405, there is an internal step 403. The base cover 5 has a central inner hole 503. The upper outside of the base cover 5 contains two raised triangle shape 501, and the upper edge of base cover 5 has two notches 502. By inserting the top of 5 to the bottom of 2 and keeping the raised triangle shape 501 at the same level as the positioning ridge 203, the base cover 5 and the atomizer tank base 2 are butted together. The rotation between the base cover 5 and the atomizer tank base 2 is limited to 180 degrees.

The connecting sleeve 3 is arranged between the threaded base 4 and the base cover 5 to form a movable ring.

The silicone base 7 has a hollow center structure, and its hollow interior is called the central hole 705. There are two V-shaped oil inlet grooves 703 symmetrically arranged at the upper outside of silicone base 7. At the lower center of 703, there is an oil inlet 704 connecting to the central hole 705. There is a sealing ring 701 between the external ridge 702 and the V-shaped oil inlet grooves 703. After assembly, the sealing ring 701 contacts the bottom of the atomizer tank 1 to form a tight seal, resulting no metal in the oil tank. The silicone base 7 contains two symmetrically arranged external ridges 702. The external ridge (702) will be inserted into the notch (502) on the base cover (5).

The ceramic heating wire 9 consists of porous ceramic 901, heating wire 902 and terminal pins 903. The heating wire 902 is at the center of the ceramic heating wire 9, which extended to two terminal pins 903 as positive and negative electrodes. The cotton pad 10 is rectangular, the ceramic heating wire 9 is wrapped in the cotton pad 10 and then placed in the central hole 705 of the silica base 7. The oil from the oil tank 102 enters the central hole 705 through the oil inlet 704, then passes the cotton pad to reach the ceramic heating wire 9 for heating and atomization.

The insulation ring 8 is placed on top of the internal step 403 in the threaded base 4, while the electrode 6 is installed in the insulation ring 8. One terminal pin 903 is connected to the threaded base 4, and the other terminal pin is placed between the insulating Ring 8 and the electrode 6, which forms an electronic circuit after assembling the atomizer with the battery and generates smoke when working.

The hollow centers of suction nozzle 101, the airflow channel 103, the silicone base 7, the base cover 5 and the threaded base 4 form the atomization channel through which the smoke is inhaled.

Steps of Assembling this Utility Model:

Step 1: fill the internal groove 202 of the atomizer tank base 2 with glue, then insert the atomizer tank 1 into the atomizer tank base 2 to fix two pieces together.

Step 2: insert the external ridge 702 of the silicone base 7 to the notch 502 on the base cover 5. The V-shaped oil inlet groove 703 is outside;

Step 3: the ceramic heating wire 9 is wrapped in the cotton pad 10 and then placed in the central hole 705 of the silica base 7. The terminal pins 903 are straightened and pulled towards the base cover 5.

Step 4: Place the external threads 402 of the threaded base 4 in a receptacle, and then place the internal thread 301 of the connecting sleeve 3 onto the side wall 404 of the threaded base 4. Pass the terminal pins 903 from step 3 through the base inner hole 405 of the threaded base, and then press the inner hole 503 of the base cover 5 into the side wall 404 of the threaded base 4. After this step, the connecting sleeve 3 is movable, and the threaded base 4 is tightly assembled to the parts from step 3.

Step 5: pass one of the terminal pins 903 of the ceramic heating wire 9 through the base inner hole 405 of the threaded base 4, and place the head of the insulating Ring 801 of insulation ring 8 into the base inner hole 405 of the threaded base 4; the other terminal pin 903 of the ceramic heating wire 9 passes between the insulation ring 8 and the inner wall of the threaded base 4. Finally, place the small electrode head 601 of the electrode 6 in the inner hole of the insulation ring 8, and then cut the exposed part of the two pins 903 of the ceramic heating wire 9 with a cutting pliers. The two terminal pins 903 of the ceramic heating wire 9 are respectively clamped on the inner and outer walls of the insulation ring 8 for insulation, at this point, the assembly of the atomizing core is completed.

Step 6: place the suction nozzle 101 downward and the atomizer tank base 2 upward to add oil, and then connect the atomizing core silicone base 7 to oil tank 102, having the upper edge of the silicone base 7 pushed to the outer wall of the airflow channel 103 to form a tight seal. The connecting sleeve 3 and the atomizer tank base 2 are connected by the internal threads 301 and the external threads 201. Then, the sealing ring of the silicone base 7 contacts the bottom of the atomizer tank to form a tight seal. Oil enters the central hole of the silicone base 7 through the oil inlet 704, then passes the cotton pad 10, and finally reaches the ceramic heating wire 9. After assembly, this product and the battery forms an electronic circuit, and the atomized gas can be inhaled.

This utility model has a glass oil tank sealed by silicone. There is no metal involved, resulting no risk of heavy metal pollution. Oil is filled in through the oil inlet located on the silicone base. This operation is easy to handle and also prevents oil leakage. The self-innovative silicone oil inlet structure ensures no oil leakage nor dry burning of the atomizing core due to poor oil supply. The glass suction nozzle and the atomizing core are tightly connected, making it easy to install and remove the atomizer from the battery, and the base will never be stuck to the battery. This utility model has an attractive appearance and is safe and convenient to use. It is environmentally friendly and convenient for oil injection. It has no risk for heavy metal pollution but provides pure taste and high degree of reduction.

Although the implementation mode of the utility model is described in combination with the attached drawings, the technicians in this field can make various deformations or modifications within the scope of the attached claims, as long as it does not exceed the protection scope described in the claims of the utility model, it should be within the protection scope of this utility model.

What is claimed is:

1. An atomizer, comprising:

a glass suction nozzle and an atomizing core, wherein the glass suction nozzle comprises an atomizer tank and an atomizer tank base; and wherein the atomizing core comprises a connecting sleeve, a threaded base, a base cover, a silicone base, a ceramic heating wire, a cotton pad, an insulating ring, and an electrode;

wherein a top of the atomizer tank is the glass suction nozzle, and the glass suction nozzle extends to form two hollow cylinders;

wherein an inner hollow cylinder forms an airflow channel, and a space between the inner hollow cylinder and an outer hollow cylinder forms the atomizer tank;

wherein a bottom of the atomizer tank is fixed to a top of atomizer tank base, and a bottom portion of the atomizer tank base contains external threads through which the atomizer tank base connects to the connecting sleeve; the threaded base being set at a bottom of the atomizing core, and the connecting sleeve being arranged between the threaded base and the base cover, and the silicone base being placed on top of the base cover, wherein a top of the silicone base forms a seal with the bottom of the atomizer tank;

wherein the ceramic heating wire is wrapped in the cotton pad and placed in the silicone base;

wherein the insulating ring is placed in the threaded base;

wherein the electrode is placed in the insulating ring;

wherein the glass suction nozzle, the silicone base, the base cover, and the threaded base each contain hollow centers; and wherein the threaded base and the silicone base contain side holes.

2. The atomizer of claim 1 wherein the connecting sleeve has internal threads through which the connecting sleeve connects to the atomizer tank base, and the connecting sleeve is arranged between the threaded base and the base cover to form a movable ring.

3. The atomizer of claim 2 wherein one end of the atomizer tank base contains external threads through which the atomizer tank base connects to the connecting sleeve, wherein an inner wall of the one end of the atomizer tank base with external threads contains a positioning ridge.

4. The atomizer of claim 3 wherein an upper side and an outer side of the base cover contains two symmetrically arranged raised triangle shapes, and an upper edge of the base cover has two symmetrically arranged notches which are disposed 90 degrees from the raised triangle shapes; and wherein a lower internal wall of the atomizer tank base contains a positioning ridge, and by inserting the top of the base cover to the bottom of the atomizer tank base and having the raised triangle shapes at a same level as the positioning ridge, the base cover and the atomizer tank base are butted together.

5. The atomizer of claim 4 wherein after assembling the base cover to the atomizer tank base, the base cover and the atomizer tank base can rotate with each other, wherein the such rotation stops when the positioning ridge meets one of the raised triangle shapes, rotation between the base cover and the atomizer tank base being limited to 180 degrees thereby.

6. The atomizer of claim 5 wherein the silicone base contains two symmetrically arranged external ridges, wherein the external ridges are each inserted into one of the notches on the base cover during assembly.

7. The atomizer of claim 6 wherein an upper outside of the silicone base contains two symmetrically arranged V-shaped oil inlet grooves and wherein at a lower center of each V-shaped oil inlet groove, there is an oil inlet;

wherein a sealing ring is disposed between the external ridge and the V-shaped oil inlet grooves; and wherein after assembly, the sealing ring contacts the bottom of the atomizer tank to form a tight seal.

8. The atomizer of claim 1 wherein the atomizer tank base has an internal groove while the atomizer tank has a connecting end with a smaller radius, wherein during assembly the internal groove is coated with glue, then inserted into the connecting end of the atomizer tank to fix the atomizer tank base and the atomizer tank together.

9. The atomizer of claim 2 wherein the glass suction nozzle, the atomizer tank, and the airflow channel are integrated to form a unified glass structure.

10. The atomizer of claim 8 wherein the glass suction nozzle, the atomizer tank, and the airflow channel are integrated to form a unified glass structure.

11. An atomizer comprising:

an oil storage chamber made of glass fused to and encompassing an airflow channel also made of glass;

wherein the oil storage chamber and airflow channel are further fused to a glass nozzle;

wherein an externally threaded metal ring is affixed to the oil storage chamber at an end opposite from the glass nozzle; and wherein the externally threaded metal ring is removably joinable with an internally threaded connecting sleeve housing an atomizing core.

12. The atomizer of claim 11 wherein a lower portion of an external wall of the oil storage chamber is tapered so that it slots into the affixed externally threaded metal ring.

13. The atomizer of claim 12 wherein the externally threaded metal ring affixed to the oil storage chamber joins with the atomizing core such that a bottom of the tapered portion of the oil storage chamber forms a seal with a base of the atomizing core, such that oil from the oil storage chamber is vaporized in the atomizing core and resulting oil vapor therefrom is transported through the airflow channel to the glass nozzle without contacting the externally threaded metal ring or the internally threaded connecting sleeve.

14. The atomizer of claim 13 wherein oil from the oil storage chamber that has saturated an absorbent material in the atomizing core is heated via heating elements embedded in the absorbent material.

15. The atomizer of claim 14 wherein the heating elements embedded in the absorbent material are ceramic.

16. The atomizer of claim 14 wherein the absorbent material is seated within a nonmetal frame with one or more grooves above a sealing ring that directs the oil into an inlet in fluid communication with the absorbent material.

17. The atomizer of claim 15 wherein the nonmetal frame housing the absorbent material and embedded heating elements is silicone rubber.

18. The atomizer of claim 15 wherein the absorbent material housed in the nonmetal frame includes cotton.

19. The atomizer of claim 14 wherein the absorbent material has a hollow center in contact with the airflow channel, thereby creating a pathway through which atomized vapor travels up the airflow channel and out of the glass nozzle.

20. The atomizer of claim 12 wherein internal threads of the atomizing core seat with external threads of the oil storage chamber such that the oil storage chamber is sealed by an annular ring at a base of the atomizing core that prevents the oil from contacting metal portions of the atomizing core.

21. An atomizer for oil, comprising:

an airflow channel having an open lower end and an open upper end in fluid communication with a nozzle, the airflow channel surrounded by an atomizer tank fixed at an upper end thereof with the airflow channel and the nozzle, and having an open lower end, the oil stored between the atomizer tank and the airflow channel;

an externally threaded metal ring fixed with the lower end of the atomizer tank; and an atomizing core comprising an internally threaded connecting sleeve, a threaded base, a base cover, a nonmetal core, a ceramic heating element, an absorbent material, an insulating ring, and an electrode;

wherein when the externally threaded metal ring is fixed with the internally threaded connecting sleeve of the atomizing core, the lower end of the atomizer tank contacts the base cover of the atomizing core to form a seal such that oil contacting the ceramic heating element is vaporized and flows through the airflow channel and nozzle without contacting the externally threaded metal ring or the internally threaded connecting sleeve.

22. The atomizer of claim 21 wherein the absorbent material includes cotton and has a hollow center in fluid communication with the open lower end of the airflow channel, and wherein the ceramic heating element is embedded in the absorbent material that is held by the nonmetal frame, the nonmetal frame having one or more grooves above a sealing ring that directs the oil from the atomizer tank into an inlet of the base that is in fluid communication with the absorbent material.

* * * * *